US009969173B2

(12) United States Patent
Yamaguchi

(10) Patent No.: US 9,969,173 B2
(45) Date of Patent: May 15, 2018

(54) INK CARTRIDGE AND INKJET RECORDING APPARATUS

(71) Applicant: Konica Minolta, Inc., Tokyo (JP)

(72) Inventor: Seiji Yamaguchi, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days. days.

(21) Appl. No.: 15/513,850

(22) PCT Filed: Oct. 6, 2015

(86) PCT No.: PCT/JP2015/078370
§ 371 (c)(1),
(2) Date: Mar. 23, 2017

(87) PCT Pub. No.: WO2016/060019
PCT Pub. Date: Apr. 21, 2016

(65) Prior Publication Data

US 2017/0282570 A1 Oct. 5, 2017

(30) Foreign Application Priority Data

Oct. 15, 2014 (JP) ..... 2014-210471

(51) Int. Cl.
*B41J 2/175* (2006.01)

(52) U.S. Cl.
CPC ..... *B41J 2/17513* (2013.01); *B41J 2/17553* (2013.01)

(58) Field of Classification Search
CPC ..... B41J 2/17513; B41J 2/17553
See application file for complete search history.

(56) References Cited

U.S. PATENT DOCUMENTS 6,341,853 B1 * 1/2002 Scheffelin ..... B41J 2/175 347/87

FOREIGN PATENT DOCUMENTS

| | | | |
|---|---|---|---|
| JP | 60-204361 | A | 10/1985 |
| JP | 2004188857 | A | 7/2004 |
| JP | 2005507807 | A | 3/2005 |

(Continued)

OTHER PUBLICATIONS

Written Opinion of PCT dated Dec. 15, 2015 for PCT/JP2015/078370 and English translation; Applicant: Konica Minolta, Inc.; Total of 11 pages.

(Continued)

*Primary Examiner* — Thinh H Nguyen
(74) *Attorney, Agent, or Firm* — Lucas & Mercanti, LLP

(57) ABSTRACT

An ink cartridge in which gel ink that is to be supplied to an ink tank of an inkjet recording apparatus is reserved, includes an ink pack and an outer box. The ink pack includes an ink container formed of a soft film material in which the ink is contained and an ink lead-out section which guides the ink inside the ink container outside. The outer box houses the ink pack and has an ink lead-out opening through which the ink lead-out section is exposed outside. The outer box has a pressure applying opening formed therein through which the ink container is exposed and a pressure is capable to be applied to the ink container or has a first perforation line along which the outer box is to be broken to form the pressure applying opening is formed thereon.

5 Claims, 10 Drawing Sheets

(56) References Cited

FOREIGN PATENT DOCUMENTS

JP 2009184318 A 8/2009

OTHER PUBLICATIONS

International Search Report dated Dec. 15, 2015 for PCT/JP2015/078370 and English translation.
Office Action dated Dec. 3, 2017 from corresponding Chinese Patent Application No. CN 201580055060.6 and English translation.

* cited by examiner

INK CARTRIDGE AND INKJET RECORDING APPARATUS

CROSS REFERENCE TO RELATED APPLICATION

This Application is a 371of PCT/JP 2015/078370 filed on Oct 6, 2015, which, in turn, claimed the priority of Japanese Patent Application No. JP 2014- 210471 filed on Oct. 15, 2014, both applications are incorporated herein by reference.

TECHNICAL FIELD

The present invention relates to an ink cartridge and an inkjet recording apparatus.

BACKGROUND ART

Traditionally, there is provided an inkjet recording apparatus in which ink is heated to reduce the viscosity level thereof and the ink of low viscosity level is ejected from an inkjet head to form an image (for example, see Patent Literature 1). With respect to such ink, for example, when it is heated to a predetermined temperature or above, it is liquefied and can be ejected. Some of these inks are in the form of gel under the normal temperature having a high viscosity level.

A type of the above described inkjet recording apparatus is provided with an intermediate tank for reserving ink. When the amount of ink in the intermediate tank becomes low, a user needs to transfer ink in to the intermediate tank from an ink cartridge to refill the intermediate tank.

PRIOR ART DOCUMENT

Patent Literature

Patent Literature 1: JP 2004-188857 A

SUMMARY OF INVENTION

Problem to be Solved by the Invention

However, if the viscosity level of the ink is high to the extent that the ink cannot drop downward by its own weight, the ink cannot be transferred completely in to the intermediate tank from the ink cartridge even if the ink cartridge is made to be upside down and ink may remain in the ink cartridge.

In view of the above, the problem to be solved by the present invention is to provide an ink cartridge which can completely transfer the ink therein whose viscosity level is high to the extent that it cannot drop downward by its own weight without having ink remained in the cartridge and an inkjet recording apparatus in which ink can be transferred from the ink cartridge.

Means for Solving the Problem

To solve the problem above, the invention according to claim 1 is an ink cartridge in which gel ink that is to be supplied to an ink tank of an inkjet recording apparatus is reserved, including:

an ink pack including an ink container formed of a soft film material in which the ink is contained and an ink lead-out section which guides the ink inside the ink container outside; and an outer box which houses the ink pack and which has an ink lead-out opening through which the ink lead-out section is exposed outside, wherein the outer box has a pressure applying opening formed therein through which the ink container is exposed and a pressure is capable to be applied to the ink container or has a first perforation line along which the outer box is to be broken to form the pressure applying opening formed thereon.

The invention according to claim 2 is the ink cartridge of claim 1, wherein the outer box has a second perforation line along which the outer box is to be broken to connect the ink lead-out opening and the pressure applying opening formed thereon.

The invention according to claim 3 is the ink cartridge of claim 1 or 2, wherein the ink lead-out section includes:

a lead-out section which is made to communicate with inside the ink container and which guides the ink outside, and a protruding section which is formed around the lead-out section and which protrudes in an axis direction of the lead-out section, wherein the protruding section is positioned according to a type of the ink contained in the ink container.

The invention according to claim 4 is the ink cartridge of any one of claims 1 to 3, wherein a plurality of incisions are made in the outer box around the ink lead-out opening, and the ink lead-out section is fixed to the outer box by engaging with the plurality of incisions.

The invention according to claim 5 is an inkjet recording apparatus which includes an ink tank in which ink is supplied from the ink cartridge of any one of claims 1 to 4, including:

a setting section where the ink cartridge is set;

a concave section which is formed in a placement surface of the setting section where the ink cartridge is placed and which matches a shape of the ink lead-out section of the ink cartridge, and an introducing pipe which is set in the concave section, which opens the ink lead-out section by breaking a seal and which is made to communicate with the ink tank.

Effects of the Invention

According to the present invention, there can be provided an ink cartridge which can completely transfer the ink therein whose viscosity level is high to the extent that it cannot drop downward by its own weight without having ink remained in the cartridge and an inkjet recording apparatus in which ink can be transferred from the ink cartridge.

DESCRIPTION OF PREFERRED EMBODIMENTS

Figure 1:
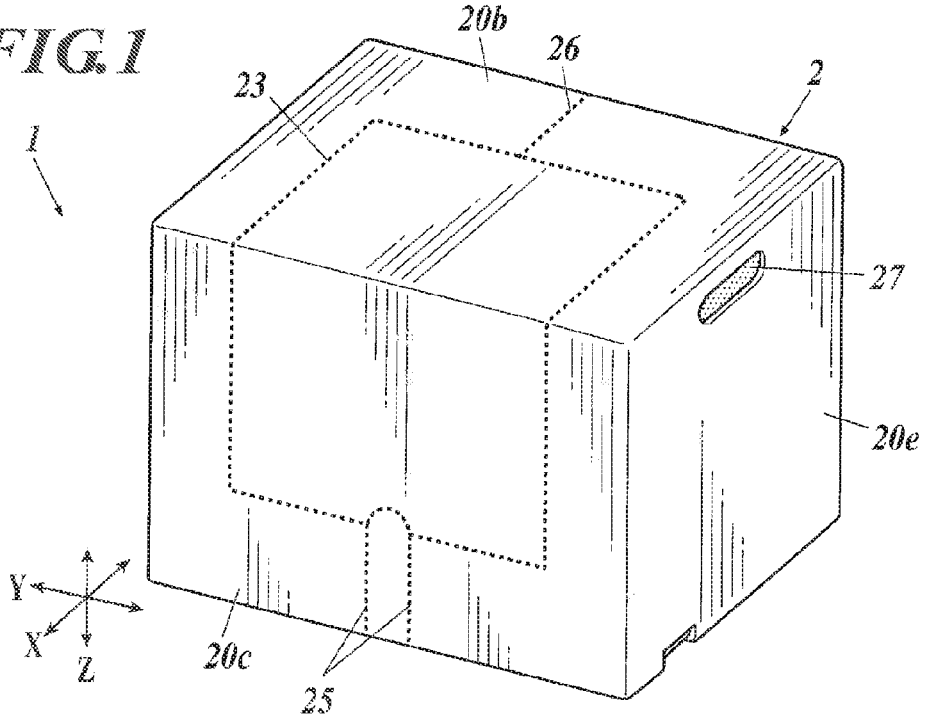
FIG. 1 This is a perspective view showing an ink cartridge according to an embodiment of the present invention.

Hereinafter, an ink cartridge and an inkjet recording apparatus according to an embodiment of the present invention will be described in detail using drawings. However, the scope of the invention is not limited to the examples shown in the drawings. In the following description, the same symbols are used for the similar functions and configurations and their descriptions are omitted.

With reference to FIGS. 1 to 8, an ink cartridge 1 according to an embodiment of the present invention will be described in detail.

Figure 12:
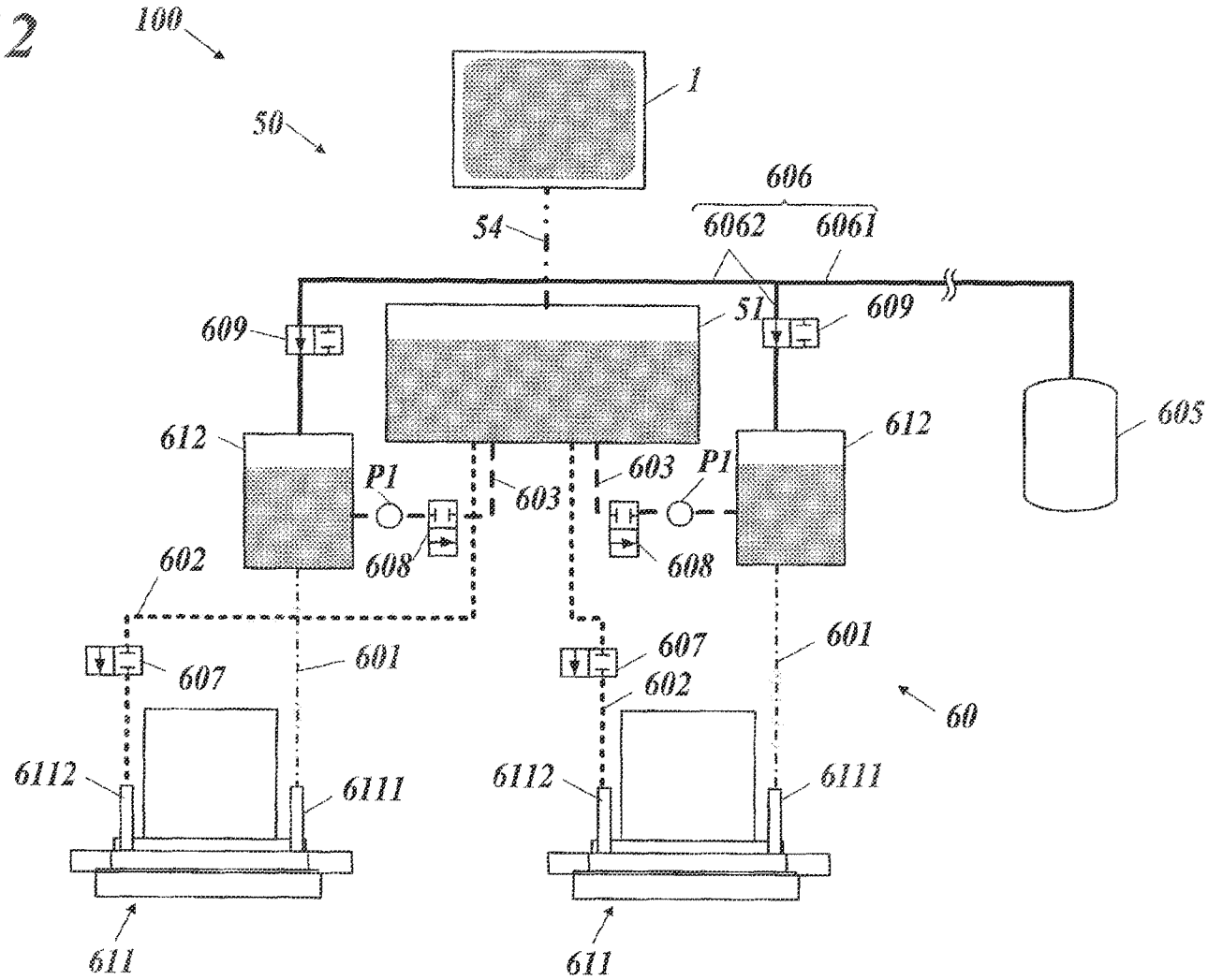
FIG. 12 This is a schematic view showing a configuration of the inkjet recording apparatus according to an embodiment of the present invention.

The ink cartridge 1 of the present invention contains and reserves gel ink inside thereof, the gel ink is to be supplied to the inkjet recording apparatus 100 and is to be ejected from an inkjet head 611 (see FIG. 12). The ink cartridge 1 includes an ink pack 3 which contains gel ink and an outer box 2 which houses the ink pack 3. Here, in the ink cartridge 1, the direction along the direction in which ink is output from the ink cartridge 1 is defined as the Z direction, the direction which is orthogonal to the Z direction, that is, the short-hand direction of the outer box 2 which is formed in an approximately rectangular shape is defined as the X direction and the direction which is orthogonal to the X direction and the Z direction is defined as the Y direction.

Here, in the present invention, gel ink is the type of ink which cannot drop downward by its own weight from a container which is made to be upside down in the normal temperature or is the type of ink having a viscosity level that only allows a part thereof drop downward by its own weight and some remains. A type of ink having a characteristic where its phase changes according to the ink temperature is an example of the above described ink. More in particular, it is a type of ink whose phase changes between gel and liquid according to the temperature or the like. These types of ink include, for example, polymerizable compound and photopolymerization initiator as the main composition and few percent by mass of a gellant material.

The outer box 2 is a box shaped member in an approximately rectangular shape for housing the ink pack 3 inside thereof. The outer box 2 covers the ink pack 3 and forms the outer surface of the ink cartridge 1 and thereby, the durability and shape stability of the ink cartridge 1 is assured. Therefore, multiple ink cartridges 1 can be places on top of each other and the transportability of the ink cartridges 1 is assured.

Figure 3:
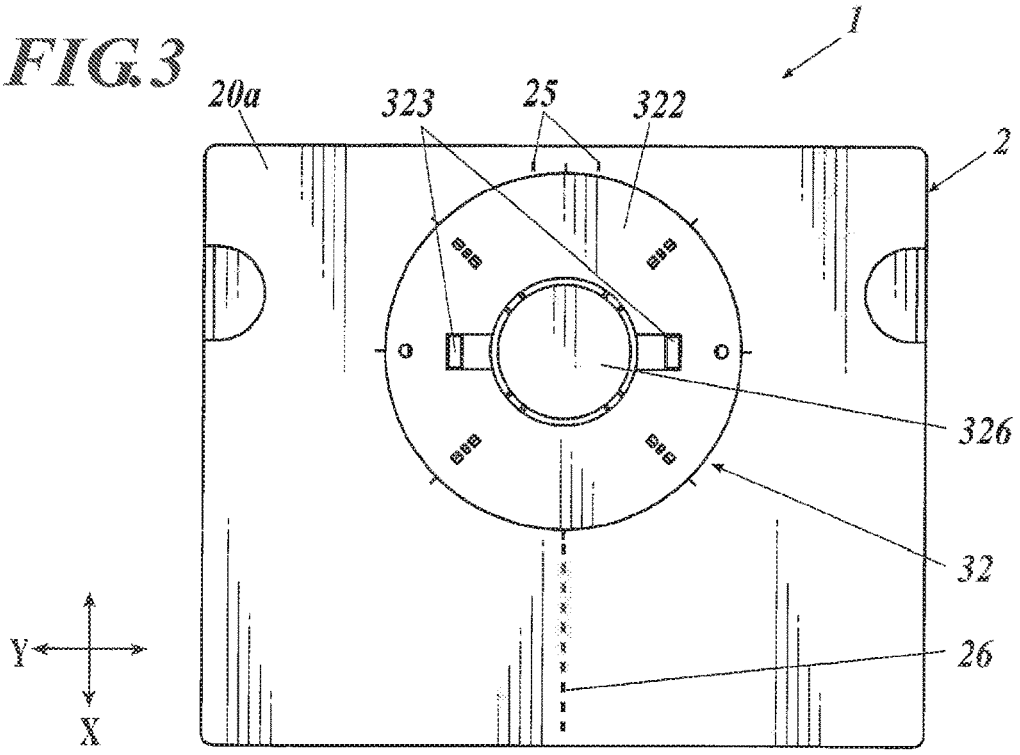
FIG. 3 This is a bottom view of the ink cartridge.
Figure 4:
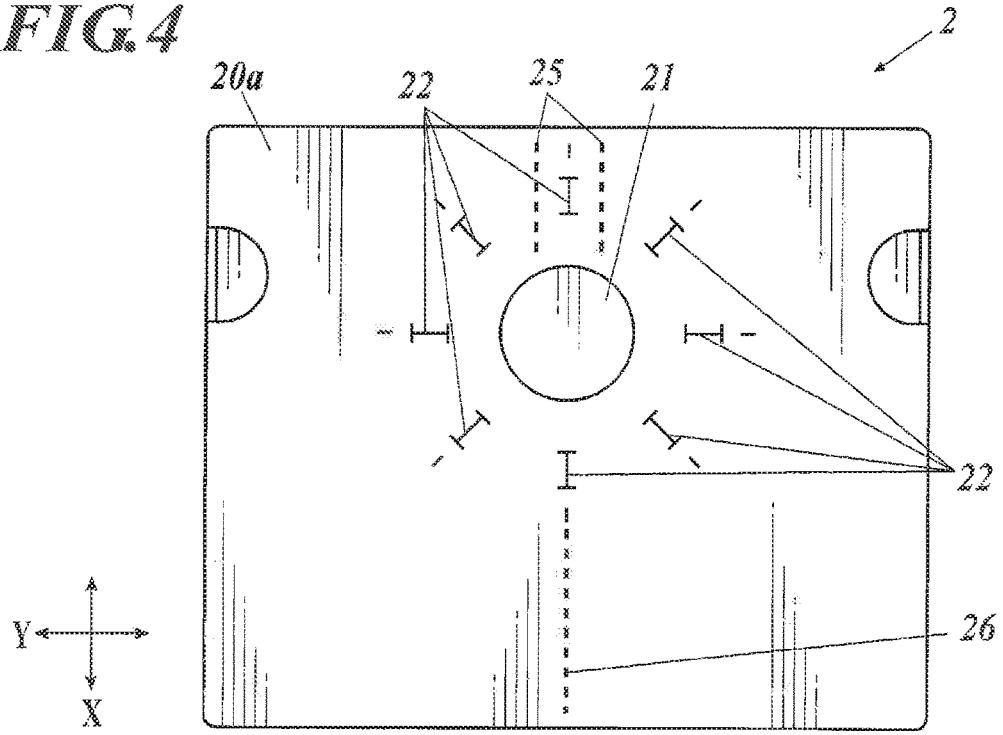
FIG. 4 This is a bottom view showing an outer box which configures the ink cartridge and here, an ink pack which is to be housed inside the outer box is omitted.

As shown in FIG. 4, an approximately round shaped ink lead-out opening 21 is formed in the bottom surface 20*a* of the outer box 2. As shown in FIG. 3, only the ink lead-out section 32 of the ink pack 3 is exposed outside the outer box 2 through the ink lead-out opening 21. Further, as shown in FIG. 4, a plurality of incisions 22 are made around the ink lead-out opening 21 in a radial manner having approximately 45 degrees pitches therebetween. The ink lead-out section 32 is fixed to the outer box 2 by engaging with any of the plurality of incisions 22.

Figure 2:
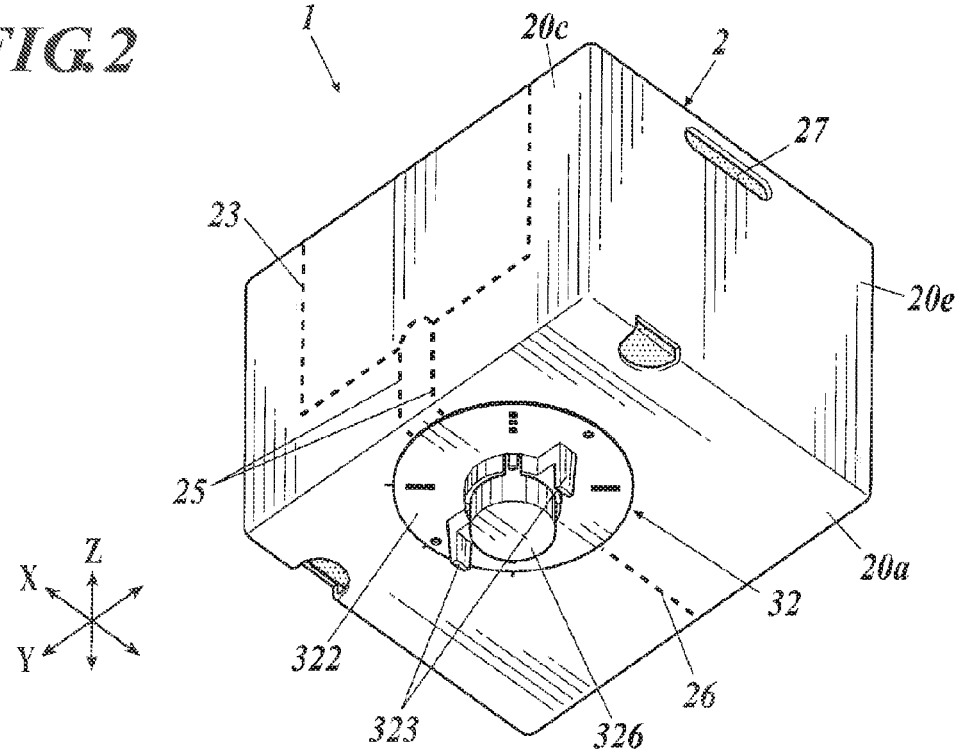
FIG. 2 This is a perspective view showing the ink cartridge.
Figure 5:
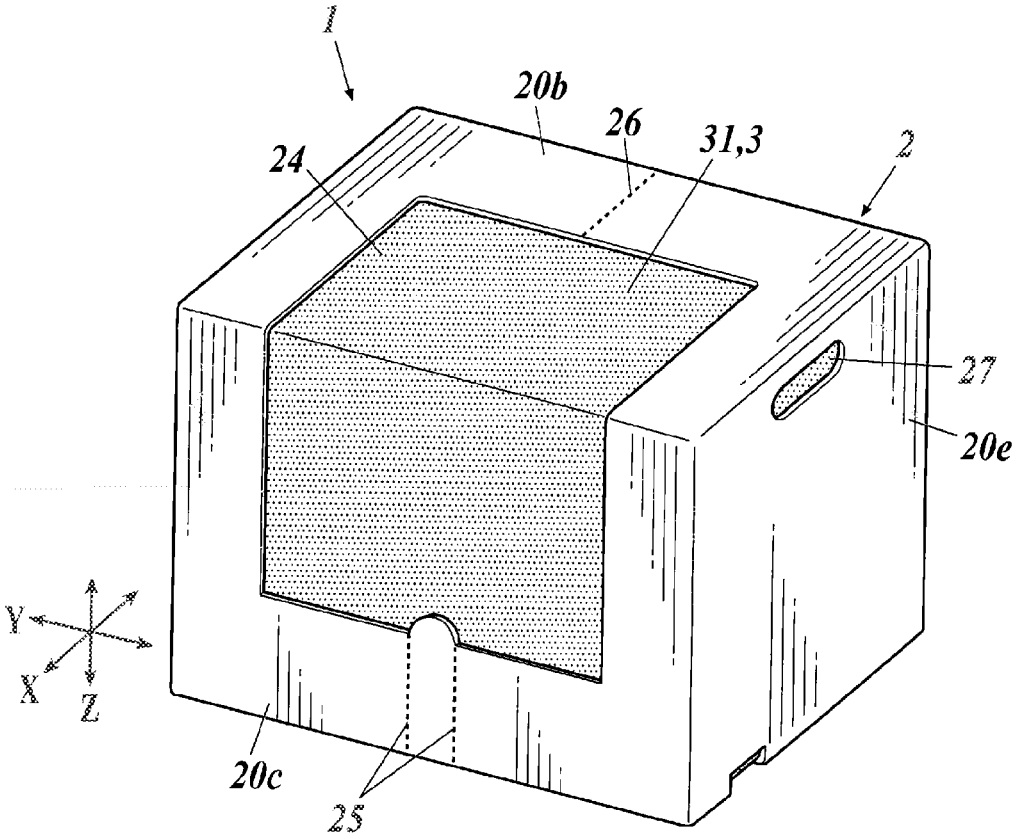
FIG. 5 This is a perspective view showing a state where a part of the outer box of the ink cartridge is broken off.

As shown in FIGS. 1 and 2, with respect to the outer box 2, the first perforation line 23 is formed across the upper surface 20*b* and the front surface 20*c* so as to encircle a part of the upper surface 20*b* and the front surface 20*c* of the outer box 2. When ink is to be supplied to the inkjet recording apparatus 100 from the ink cartridge 1, a part of the outer box 2 is broken off along the first perforation line 23 and removed to form a pressure applying opening 24 as shown in FIG. 5. Due to the pressure applying opening 24 being formed in the outer box 2, a part of the ink pack 3 is exposed.

Here, although the first perforation line 23 is formed on the outer box 2 and the pressure applying opening 24 is formed by a user breaking the outer box 2 along the first perforation line 23, the pressure applying opening 24 may be directly formed in the outer box 2 without having the first perforation line 23 formed as long as the durability and shape stability of the outer box 2 is assured.

Further, as shown in FIGS. 1 to 5, the second perforation lines 25 and 26 along which the outer box 2 can be broken to connect the ink lead-out opening 21 and the pressure applying opening 24 are formed on the outer box 2. The second perforation line 25 is formed across the bottom surface 20*a* and the front surface 20*c* and the second perforation line 26 is formed across the bottom surface 20*a*, the back surface 20*d* and the upper surface 20*b*. In such way, the second perforation lines 25 and 26 are formed approximately in parallel with the Z-X plane so as to go around the circumference of the outer box 2. Further, as shown in FIGS. 1, 2, 4 and 5, two second perforation lines 25 are formed on the front surface 20*c* so as to extend toward inside the pressure applying opening 24.

Figure 6:
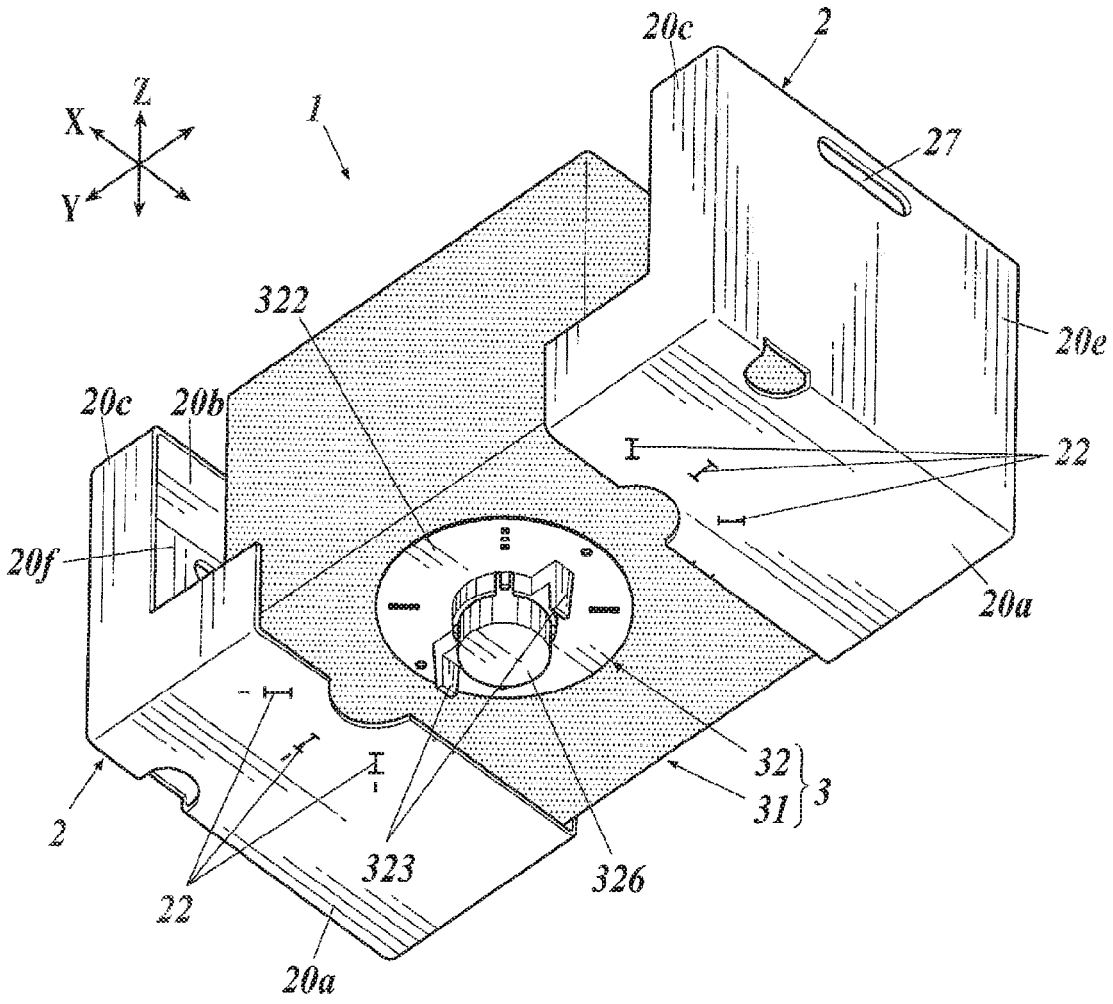
FIG. 6 This is a perspective view showing a state where a part of the outer box of the ink cartridge is broken off and the outer box is divided.
Figure 7:
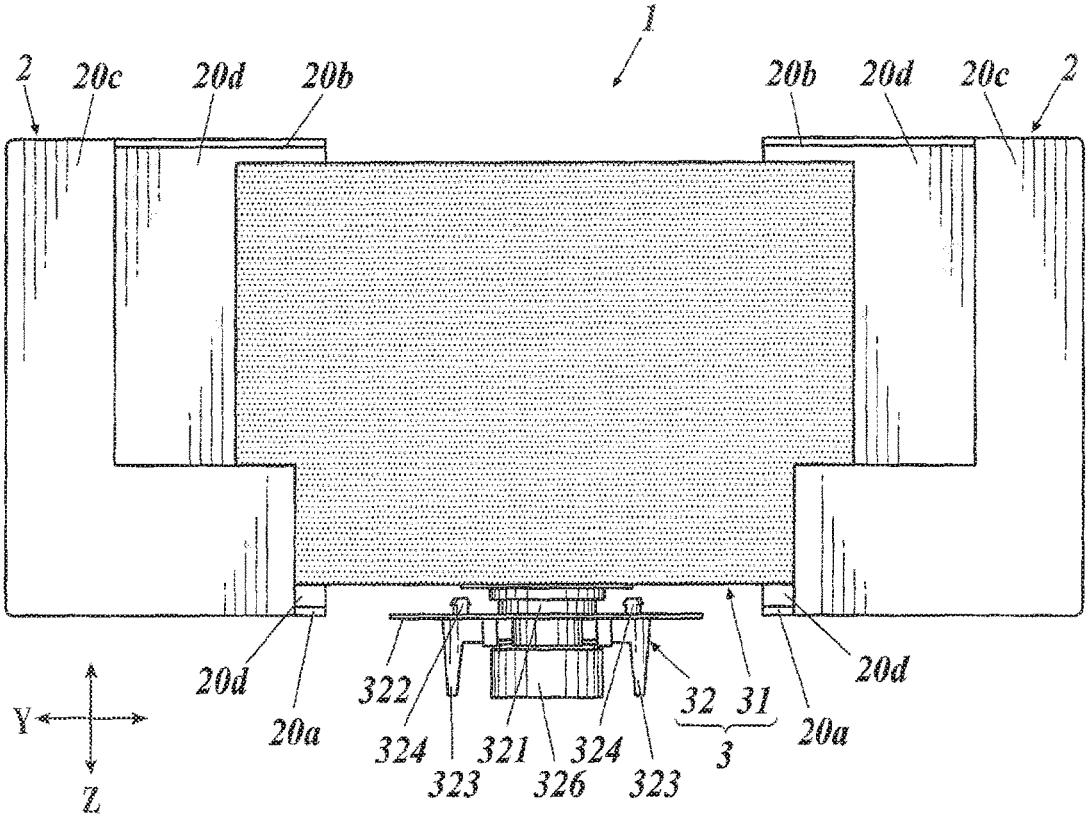
FIG. 7 This is a front view showing the state where a part of the outer box of the ink cartridge is broken off and the outer box is divided.

Since the second perforation lines 25 and 26 are formed, the outer box 2 can be divided into two pieces by breaking it along the perforation lines as shown in FIGS. 6 and 7 after the ink is transferred in to the inkjet recording apparatus 100 from the ink cartridge 1.

In particular, the outer box 2 is broken from the part of the second perforation lines 25 extending toward inside the pressure applying opening 24 in the direction approaching the ink lead-out opening 21 along the front surface 20*c* and the bottom surface 20*a*. In such way, the side surfaces 20*e* and 20*f* of the outer box 2 slightly separate from each other. Then, by applying a force to the outer box 2 so as to further separate the side surfaces 20*e* and 20*f* from each other, the outer box 2 is broken along the second perforation line 26 across the bottom surface 20*a*, the back surface 20*d* and the upper surface 20*b* and the outer box 2 is divided into two pieces.

In such way, the used ink cartridge 1 can be easily separated into the outer box 2 and the ink pack 3 and the ink cartridge 1 can be disposed easily.

Further, as shown in FIGS. 1, 2 and 5, grasping holes 27 are formed in the outer box 2 in the side surfaces 20*e* and 20*f* on the side of the upper surface 20*b*. In such way, the transportability of the ink cartridge 1 is further improved.

The outer box 2 having the configuration as described above can assure the durability and shape stability of the ink cartridge 1 and any material can be used to form the outer box 2 as long as the outer box 2 can be broken along the first perforation line 23 and the second perforation lines 25 and 26. For example, materials used to form regular boxes such as paper materials including board paper, cardboard paper and the like, thermoplastic resin and the like are suggested.

The ink pack 3 includes a bag shaped ink container 31 made of a soft film material for containing ink inside thereof and a resin made ink lead-out section 32 through which the ink inside the ink container 31 is guided outside.

As for the soft film material by which the ink container 31 is made, any material can be used as long as the ink can be preserved for a long period of time without the ink being damaged in the state being contained in the ink container 31. For example, low density polyethylene (LDPE), linear low density polyethylene (LLDPE), low density polyethylene (LDPE) made by using metallocene catalyst, linear low density polyethylene (LLDPE) or a film made by combining the above films and high density polyethylene (HDPE) film can be used. Among these, LLDPE made by using metallocene catalyst is preferred in particular in terms of its melting temperature and strength. The ones sold on the market can be used. For example, UMERIT manufactured by UBE Industries, LTD., AFFIMITY and ELITE manufactured by the DOW Chemical Company, HARMOLEX LL manufactured by Japan Polyolefins CO., LTD., KERNEL 57L manufactured by Japan Polychem Corporation, EVOLUE manufactured by Mitsui Chemicals, Lamilon Super manufactured by Sekisui Film CO., LTD., SE series manufactured by Tamapoly CO., LTD., Tohcello T.U.X-FCS, T.U.X-TCS manufactured by Mitsui Chemicals Tohcello, Inc., Taiko FL manufactured by Futamura Chemical CO., LTD., Metaro Ace manufactured by Mitsubishi Chemical Kohjin PAX Corporation, WMX manufactured by Osaka Wada Chemical Industry CO., LTD., FV202 manufactured by Sumitomo Chemical CO., LTD., etc. are suggested.

With respect to the ink container 31, a part thereof is to be exposed through the pressure applying opening 24 when the outer box 2 is broken along the first perforation line 23 and the pressure applying opening 24 is formed as shown in FIG. 5. Since the ink container 31 is made of a soft film material, the ink inside the ink container 31 can be output efficiently from the ink lead-out section 32 by a user manually applying a pressure to the part exposed through the pressure applying opening 24. Further, since the ink is output while applying a pressure to the ink container 31, the ink inside the ink container 31 can be transferred in to the inkjet recording apparatus 100 almost completely without ink remaining in the ink container 31.

Further, as for the soft film material, it is preferred to use a material having light blocking property since such material can suppress the denaturing of the ink more reliably.

As for the shape of the ink container 31, although the ink container 31 can be formed in any shape as long as it can be housed inside the outer box 2, it is preferred that the ink container 31 has an approximately same shape as the outer box 2 in the state where ink is contained inside thereof. In such way, the ink pack 3 in the state having ink contained therein can be prevented from moving when it is housed inside the outer box 2 and the transportability of the ink cartridge 1 can be improved even more.

As shown in FIGS. 2 and 3, the ink led-out section 32 is exposed outside the outer box 2 and guides the ink contained in the ink container 31 outside. As for the material used to form the ink lead-out section 32, it is not limited as long as the material is strong enough so as not to cause any problem when supplying the ink inside the ink container 31 in to the inkjet recording apparatus 100. For example, a thermoplastic resin such as polyethylene, polystyrene, polyamide, polypropylene and the like are suggested.

As shown in FIGS. 2, 3, 6 and 7, the ink lead-out section 32 includes a lead-out section 321 which is made to communicate with inside the ink container 31 and which guides the ink outside, a plate-like section 322 which is fixed to the lead-out section 321, protruding sections 323 formed around the lead-out section 321 and protrude along the axis direction of the lead-out section 321, engaging nails 324 which engage with any of the plurality of incisions 22 of the outer box 2 and the like.

As shown in FIG. 7, the lead-out section 321 is formed in an approximately cylinder shape whose axis direction is set along the Z direction. Further, the diameter of the lead-out section 321 formed in an approximately cylinder shape is formed so as to be smaller than the diameter of the ink lead-out opening 21 of the outer box 2. Further, the end part of the lead-out section 321 is sealed by a sealing material 325 before the ink is to be supplied to the inkjet recording apparatus 100 (see FIG. 11). Further, as shown in FIGS. 2, 3, 6 and 7, the end part of the lead-out section 321 and the sealing material 325 are covered with a cover 326 which is detachably attached. In such way, ink can be prevented from leaking from the lead-out section 321 when the ink cartridge 1 is being transported.

As shown in FIG. 7, the plate-like section 322 is set along the direction approximately orthogonal to the Z direction and is fixed to the outer circumference of the lead-out section 321. The plate-like section 322 is formed in an approximately disk shape and is positioned so as to have the same axis with the lead-out section 321 when seen in the axis direction of the lead-out section 321. Further, the diameter of the plate-like section 322 is formed so as to be sufficiently larger than the diameter of the ink lead-out opening 21 to the extent that the plate-like section 322 cannot pass through the ink lead-out opening 21 of the outer box 2. Since such plate-like section 322 is provided, the ink lead-out section 32 which is exposed outside the outer box 2 through the ink lead-out opening 21 of the outer box 2 can be restricted from changing its direction with respect to the bottom surface 20*a* of the outer box 2. Therefore, the supplying process of ink in to the inkjet recording apparatus 100 from the ink cartridge 1 can be carried out efficiently.

As shown in FIGS. 2, 3, 6 and 7, two protruding sections 323 are respectively formed on two sides of the lead-out section 321 so as to have the center axis of the lead-out section 321 therebetween. The protruding sections 323 are fixed to the outer circumference of the lead-out section 321 and are also fixed to the surface of the plate-like section 322 which is the opposite of the surface that faces the outer box 2. Further, the two protruding sections 323 are protruded toward the direction going away from the outer box 2 along the Z direction.

Here, the shape and the number of the protruding sections 323 are not limited to the above examples and the protruding sections 323 formed in any shape can be provided in any number as long as the shape and the number match an aftermentioned concave section 53 formed in the inkjet recording apparatus 100.

As shown in FIG. 7, the engaging nails 324 are fixed to the surface of the plate-like section 322 which faces the outer box 2 and protrudes toward the direction opposite of the direction in which the protruding sections 323 protrude, that is, protrudes toward the direction approaching the outer box 2. Two engaging nails 324 are respectively provided at the positions corresponding to the two protruding sections 323 having the plate-like section 322 between the engaging nails 324 and the protruding sections 323, and the engaging nails 324 engage with any two of the plurality of incisions 22 made in the outer box 2. In such way, the ink lead-out section 32 can be fixed to the outer box 2 and the supplying process of ink in to the inkjet recording apparatus 100 from the ink cartridge 1 can be carried out efficiently.

Figure 8A:
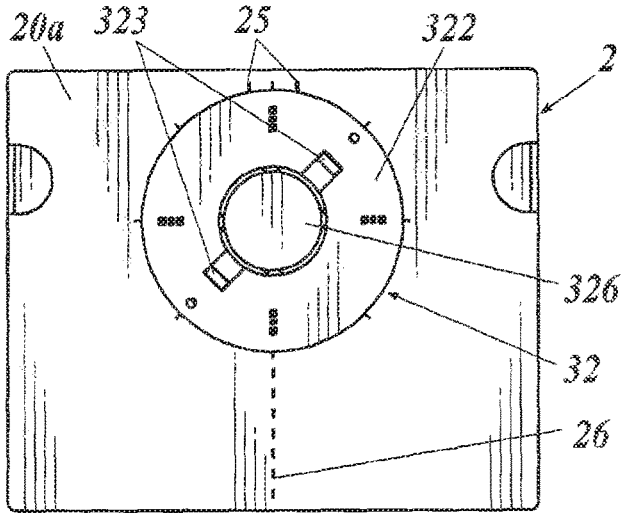
FIG. 8A This is a bottom view of an ink cartridge and shows an example of the way an ink lead-out section is positioned.
Figure 8B:
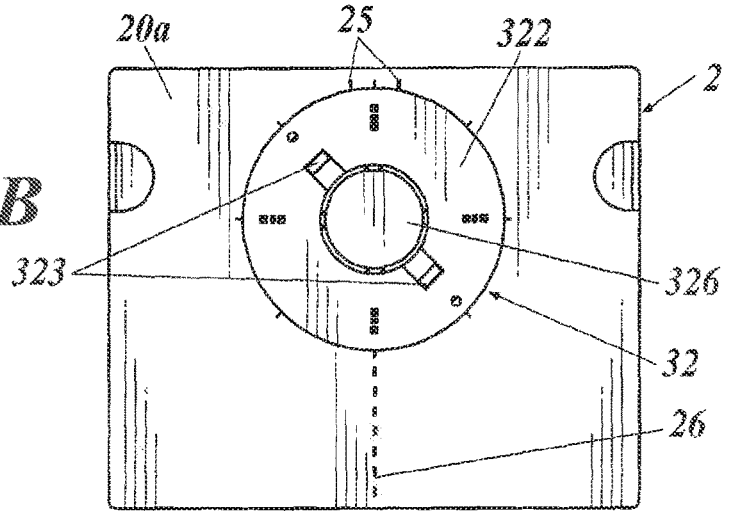
FIG. 8B This is a bottom view of an ink cartridge and shows an example of the way an ink lead-out section is positioned.
Figure 8C:
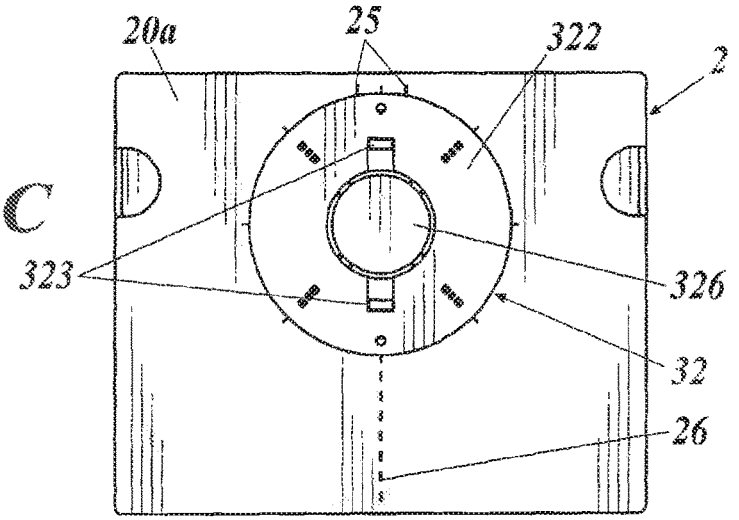
FIG. 8C This is a bottom view of an ink cartridge and shows an example of the way an ink lead-out section is positioned.

Further, by changing the engaging positions of the engaging nails 324 among the plurality of the incisions 22, the position of the ink lead-out section 32 can be changed around the Z direction. In such way, as shown in FIGS. 8A to 8C, the positions of the two protruding sections 323 of the ink lead-out section 32 can be changed and the two protruding sections 323 can be positioned differently according to the color of the ink which is contained in the ink pack 3. Thereby, by a user confirming the positions of the protruding sections 323, the color of the ink which is contained in the ink cartridge 1 can be discriminated and ink of a different color can be prevented from being mistakenly supplied to the inkjet recording apparatus 100.

The ink cartridge 1 which is configured as described above can be manufactured as described below, for example.

That is, first, the ink lead-out section 32 does not have the plate-like section 322, the protruding sections 323 and the engaging nails 324, and the ink pack 3 only having the lead-out section 321 is housed in the outer box 2. At this time, the ink pack 3 is placed in the outer box 2 so that the lead-out section 321 is exposed outside the outer box 2 through the ink lead-out opening 21. Next, the plate-like section 322 on which the protruding sections 323 and the engaging nails 324 are fixed is placed near the lead-out section 321 which is exposed through the ink lead-out opening 21, and the engaging nails 324 are made to engage with any of the plurality of the incisions 22. In such way, the protruding sections 323 are positioned differently according to the color of the ink which is contained in the ink pack 3. Next, the plate-like section 322 is fixed to the lead-out section 321 by welding or the like. The end of the fixed lead-out section 321 is sealed with the sealing material 325 and the cover 326 is attached to the lead-out section 321.

The ink cartridge 1 can be manufactured in such way.

With reference to FIGS. 9 to 12, supplying of ink in to the intermediate tank 51, which is the ink tank of the inkjet recording apparatus 100, from an ink cartridge 1 will be described.

Figure 9:
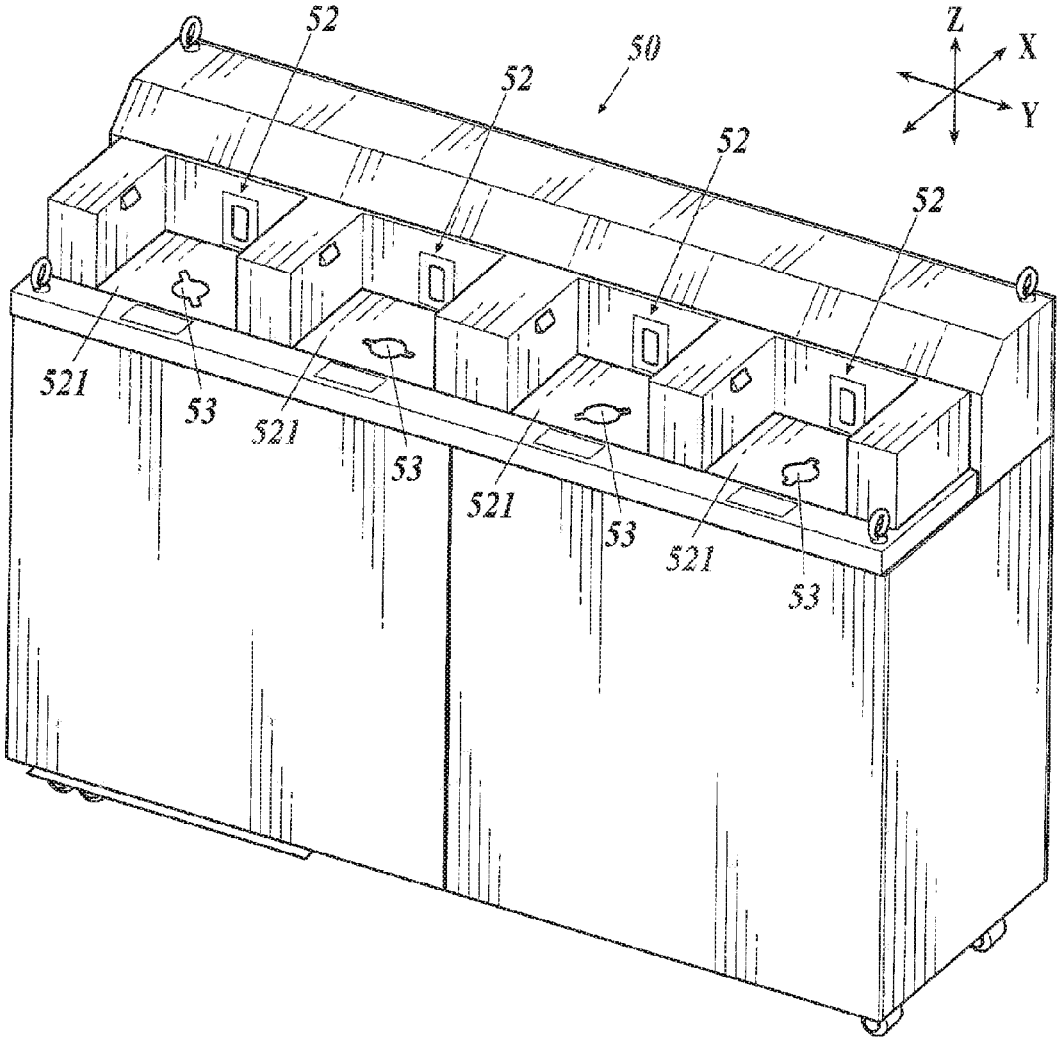
FIG. 9 This is a perspective view showing an ink supply unit which configures the inkjet recording apparatus of the present invention.
Figure 10:
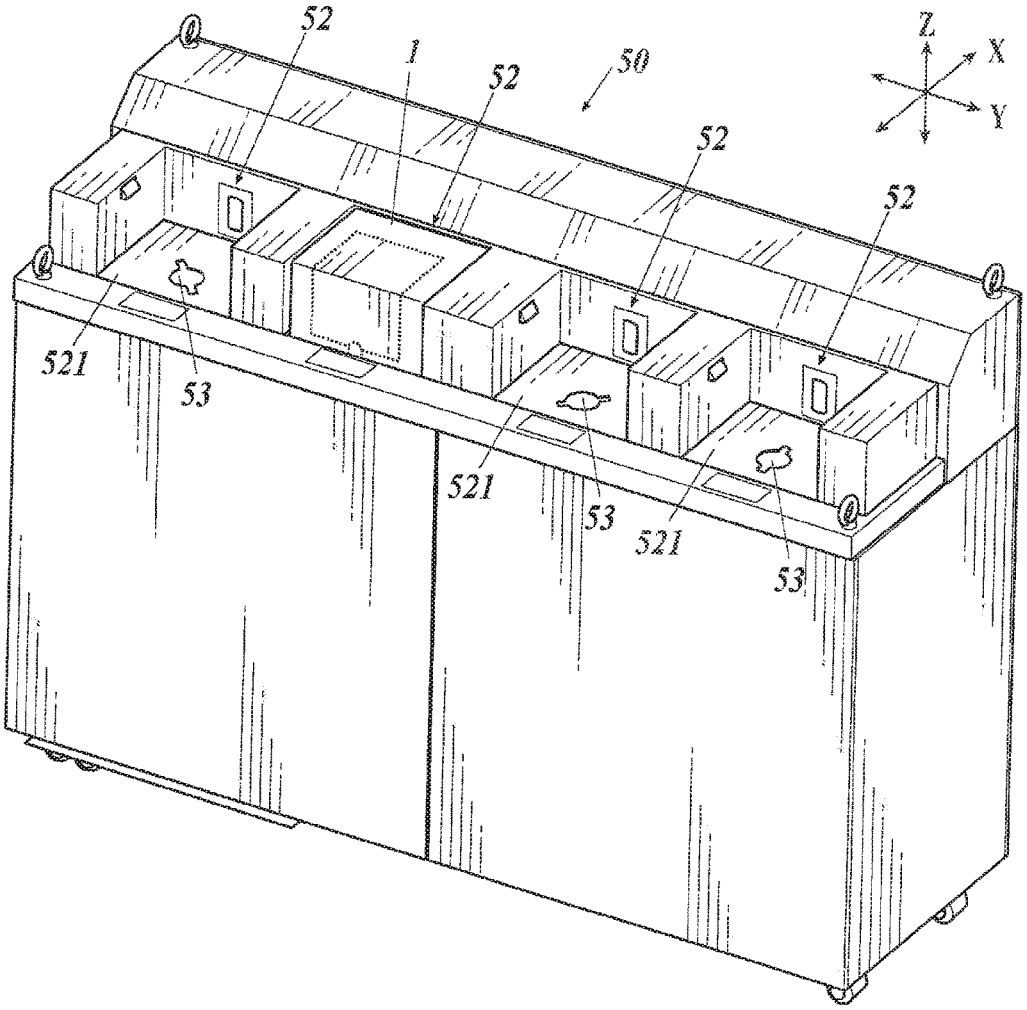
FIG. 10 This is a perspective view showing a state where an ink cartridge is set in the ink supply unit.

The ink supply unit 50 shown in FIGS. 9 and 10 has the intermediate tank 51 as shown in FIG. 12 built therein and supplies the ink which is supplied in to the intermediate tank 51 from the ink cartridge 1 to the aftermentioned ink ejection mechanism 60.

Figure 11:
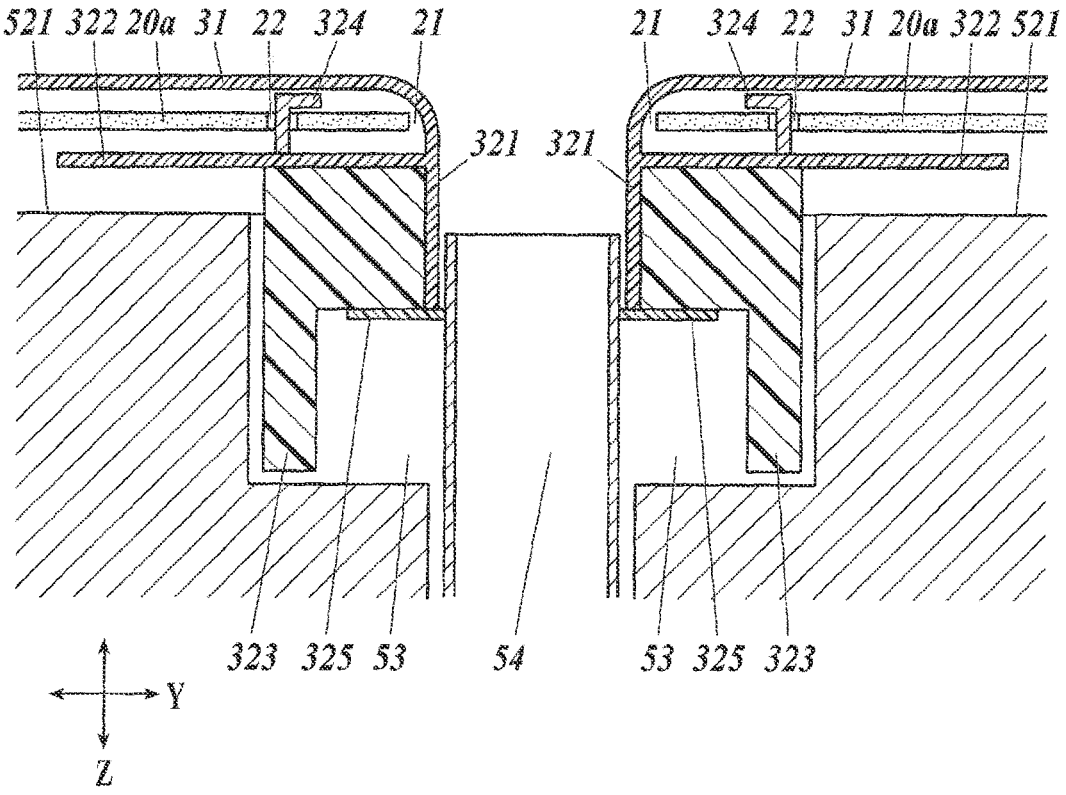
FIG. 11 This is a schematic cross-sectional view showing a connecting part of an ink cartridge and the ink supply unit.

As shown in FIGS. 9 to 11, the ink supply unit 50 includes setting sections 52 where ink cartridges 1 are to be set, concave sections 53 which are formed in the placement surfaces 521 of the setting sections 52 where the ink cartridges 1 are to be placed, the concave sections 53 matching the shapes of the ink lead-out sections 32 of the ink cartridges 1, introducing pipes 54 which are set inside the concave sections 53, which open the lead-out sections 321 by ripping the sealing materials 325 of the ink lead-out sections 32 and which are made to communicate with the intermediate tank 51 and the like. Here, the ink cartridges 1 are to be set in the setting sections 52 in a state where the covers 326 are removed.

As shown in FIGS. 9 and 10, the setting sections 52 are provided for the colors of C (cyan), M (magenta), Y (yellow) and K (black). The setting sections 52 are formed so as to match the shape and size of the ink cartridges 1, and the setting sections 52 support and restrict the setting direction of the ink cartridges 1 set therein. That is, as shown in FIG. 9, an ink cartridge 1 set in a setting section 52 is placed so that only two surfaces, the upper surface 20*b* and the front surface 20*c*, be exposed. Since each of the ink cartridges 1 is set in such manner, the pressure applying opening 24 can be formed by breaking the outer box 2 along the first perforation line 23 after the ink cartridge 1 is set in the setting section 52.

Here, although FIG. 10 shows the state where an ink cartridge 1 is set only in one setting section 52, the ink cartridges 1 can also be set in other setting sections 52 and inks of different colors can be supplied at the same time.

As shown in FIGS. 9 to 11, the concave sections 53 are formed in the placement surfaces 521 of the individual setting sections 52 and they are formed in the shapes matching the shapes of the ink lead-out sections 32 of the ink cartridges 1. In such way, the ink lead-out sections 32 of the ink cartridges 1 set in the setting sections 52 fit in the concave sections 53. Further, the concave sections 53 are respectively formed in the individual setting sections 52 which are provided for different colors, the concave sections 53 being formed in different directions corresponding to the different colors. As described above, since the protruding sections 323 of the ink cartridges 1 are positioned differently according to the ink colors, only the ink lead-out section 32 of the ink cartridge 1 in which the ink of the corresponding color is contained fits in each of the concave sections 53 formed in different directions according to the ink colors.

As shown in FIG. 11, the introducing pipes 54 are respectively set inside the concave sections 53 and their end parts are positioned below than their corresponding placement surfaces 521. In such way, when the ink cartridges 1 are set and the ink lead-out sections 32 fit in the concave sections 53, the introducing pipes 54 push through and rip the sealing materials 325 by which the lead-out sections 321 of the ink cartridges 1 are sealed to open the lead-out sections 321. Further, the introducing pipes 54 are made to communicate with the intermediate tank 51, and the introducing pipes 54 connect the individual ink cartridges 1 and the ink supply unit 50 by being inserted inside the lead-out sections 321 after ripping the sealing materials 325. By having such configuration, the ink cartridges 1 can be opened just by the ink cartridges 1 being set in their corresponding setting sections 52 and thus, the supplying process of ink to the inkjet recording apparatus 100 from the ink cartridges 1 can be carried out easily.

Further, since the concave sections 53 are formed in different directions according to the ink colors and the introducing pipes 54 are respectively set inside the concave sections 53, only the ink cartridge 1 containing ink of the color corresponding to each setting section 52 is to be opened. In such way, even if a user mistakenly sets an ink cartridge 1 containing ink that does not match the color corresponding to the particular setting section 52, the ink cartridge 1 will not be opened and ink of different color can be prevented from being supplied to the intermediate tank 51.

Next, with reference to FIG. 12, the inkjet recording apparatus 100 will be described.

The inkjet recording apparatus 100 includes the ink supply unit 50 and the ink ejection mechanism 60.

The ink ejection mechanism 60 includes sub tanks 612 in which the ink supplied from the ink supply unit 50 is reserved, inkjet heads 611 which ejects the ink supplied from the sub tanks 612, a pressure controller 605 which makes the pressure at the nozzles of the inkjet heads 611 be a negative pressure, paths 603 which connect the intermediate tank 51 and the sub tanks 612, supplying paths 601 which connect the sub tanks 612 and their corresponding inkjet heads 611, collecting paths 602 which connect the inkjet heads 611 and the intermediate tank 51, an air path 606 which connects the sub tank 51 and the pressure controller 605 and the like. The intermediate tank 51 and the individual parts forming the ink ejection mechanism 60 respectively include heaters which are not shown in the drawings to heat the ink so as to make the ink flow and the ink is ejected in the state where the viscosity level thereof is reduced.

Here, although various paths which are ink paths are shown in dotted lines and the like in FIG. 12, the specific configuration of these paths is a closed path through which ink flows.

In the intermediate tank 51 of the ink supply unit 50, the ink which flows through each part of the ink ejection mechanism 60 is reserved and the reserved ink is supplied to the sub tanks 612.

In the sub tanks 612, the ink supplied from the intermediate tank 51 is reserved and the reserved ink is supplied to the inkjet heads 611. Here, although only two sub tanks 612 are included in the example shown in FIG. 12, the sub tanks 612 can be provided more according to the number of the inkjet heads 611.

Each of the inkjet heads 611 includes a plurality of nozzles, and an image is formed on a recording medium by ejecting ink through the plurality of nozzles. Here, although only two inkjet heads 611 are included in the example shown in FIG. 12, the inkjet heads 611 can be provided more according to the number of colors of the ink.

The pressure controller 605 is connected to the sub tanks 612 and adjusts the pressure inside each of the sub tanks 612 under the control of the controller (not shown). In such way, the pressure controller 605 makes the pressure at the nozzles of the inkjet heads 611 be in the state of negative pressure via the sub tanks 612 and the supplying paths 601. Thereby, ink can be prevented from leaking from the nozzles when image forming and various types of maintenances are not carried out.

Each of the supplying paths 601, the collecting paths 602 and the paths 603 and 604 are tube-like members in which ink passes through. The tube-like members are made of a material such as a resin or the like or a material having a good heat transferring characteristic, for example.

The paths 603 connect the intermediate tank 51 and the sub tanks 612, and each of the paths 603 includes a pump P1. Each of the pumps P1 operates under the control of a controller (not shown) and supplies ink to its corresponding sub tank 612 from the intermediate tank 51. As for the pumps P1, for example, positive-displacement pumps such as diaphragm pumps, tube pumps or the like are used.

Each of the supplying paths 601 connects a sub tank 612 and an inlet 6111 of an inkjet head 611. Further, each of the collecting paths 602 connects an outlet 6112 of an inkjet head 611 and the intermediate tank 51.

The air path 606 connects the sub tanks 612 and the pressure controller 605. The air path 606 is a tube-like member in which air passes through. The tube-like member is made of a material such as a resin, for example. With respect to the air path 606, a plurality of branching air paths 6062 which respectively connect with the plurality of sub tanks 612 branch from the common air path 6061 which is connected to the pressure controller 605.

Further, the collecting paths 602, the paths 603 and the branching air paths 6062 respectively include solenoid valves 607, 608 and 609. The solenoid valves 607 to 609 open and close their corresponding ink flow paths and air paths in which they are provided under the control of the controllers (not shown). That is, the solenoid valves 607 respectively provided in the collecting paths 602 switch between open and close states of the collecting paths 602. The solenoid valves 608 which are provided between the intermediate tank 51 and the pumps P1 in the paths 603 switch between open and close states of the connections between the intermediate tank 51 and the pumps P1. The solenoid valves 609 respectively provided in the branching air paths 6062 switch between open and close states of the connections between the sub tanks 612 and the pressure controller 605.

Here, the sub tanks 612 are tank-like containers that are closed and sealed except for the above described connecting parts. That is, the pressure inside each sub tank 612 changes according to the level of negative pressure applied by the pressure controller 605, whether ink is supplied from the intermediate tank 51 and the like. For example, if a sub tank 612 receives ink supply from the intermediate tank 51 in the state where the negative pressure applied from the pressure controller 605 is lost due to the solenoid valve 609 be in the closed state, the pressure inside the sub tank 612 increases as the amount of ink in the sub tank 612 increases.

On the other hand, the intermediate tank 51 is a container which is opened toward outside and its pressure is maintained at approximately atmospheric pressure regardless of increase and decrease in the amount of ink.

As described above, according to the embodiment, an ink cartridge 1 which contains gel ink that is to be supplied to the intermediate tank 51 of the inkjet recording apparatus 100 includes the ink pack 3 provided with the ink container 31 made of a soft film material in which ink is contained and the ink lead-out section 32 which guides the ink inside the ink container 31 outside and the outer box 2 provided with the ink lead-out opening 21 through which the ink lead-out section 32 is exposed outside, the outer box 2 housing the ink pack 3. Further the outer box 2 is provided with the pressure applying opening 24 through which the ink container 31 is exposed and a pressure can be applied to the ink container 31 or the first perforation line 23 along which the outer box 2 can be broken to form the pressure applying opening 24. Therefore, a user can apply pressure to the ink container 31 from the pressure applying opening 24. In such way, even if the viscosity level of the ink does not allow the ink to drop downward by its own weight, ink can be efficiently output from the ink lead-out section 32 and can be transferred in to the inkjet recording apparatus 100 almost completely without having ink remained in the ink container 31.

Further, in the case where the pressure applying opening 24 is already formed, a user does not need to form the pressure applying opening 24 by breaking the outer box 2 along the first perforation line 23. Therefore, the supplying process of ink to the inkjet recording apparatus 100 from the ink cartridge 1 can be carried out more easily.

In the case where the first perforation line 23 is formed, the outer box 2 does not have the pressure applying opening 24 before the ink is to be output. Therefore, the outer box 2 has good durability and shape stability before the ink is to be output and the transportability of the ink cartridge 1 is improved. Further, since the pressure applying opening 24 is not formed in the outer box 2 before the ink is to be output, the ink container 31 and the ink contained therein can be protected more reliably when transporting the ink cartridge 1 or in other situations.

Moreover, since the outer box 2 is provided with the second perforation lines 25 and 26 along which the outer box 2 can be broken to connect the ink lead-out opening 21 and the pressure applying opening 24, a user can break the outer box 2 along the second perforation lines 25 and 26 so as to divide the outer box 2 to take the ink pack 3 out from the outer box 2. In such way, the used ink cartridge 1 can be easily separated into the outer box 2 and the ink pack 3 and the ink cartridge 1 can be disposed easily.

Further, the ink lead-out section 32 includes the lead-out section 321 which is made to communicate with inside the ink container 31 and which guides the ink outside and the protruding sections 323 which are formed around the lead-out section 321 and which protrude along the axis direction of the lead-out section 321, the protruding sections 323 being positioned differently according to the type of the ink contained in the ink container 31. Therefore, a user can discriminate the color of the ink contained in the ink cartridge 1 by confirming the position of the protruding sections 323 and ink of different color can be prevented from being mistakenly supplied to the inkjet recording apparatus 100.

Moreover, a plurality of incisions 22 are made around the ink lead-out section opening 21 of the outer box 2 and the ink lead-out section 32 is fixed to the outer box 2 by engaging with the plurality of incisions 22. Therefore, the supplying process of ink in to the inkjet recording apparatus 100 from the ink cartridge 1 can be carried out efficiently.

Furthermore, the inkjet recording apparatus 100 provided with the intermediate tank 51 in which ink is supplied from an ink cartridge 1 includes the setting sections 52 where ink cartridges 1 are set, the concave sections 53 which are formed in the placement surfaces 521 of the setting sections 52 where ink cartridges 1 are placed, the concave sections 53 being formed so as to match the shapes of the ink lead-out sections of the ink cartridges 1, and the introducing pipes 54 which are set inside the concave sections 53, which open the sealing of the ink lead-out sections 32 by ripping the sealing materials and which communicate with the intermediate tank 51. Therefore, the supplying process of ink to the inkjet recording apparatus 100 from the ink cartridges 1 can be carried out easily.

Here, in the above described embodiment, ink is output by a user manually applying pressure to the ink container 31 through the pressure applying opening 24 formed in the outer box 2. However, for example, the ink supply unit 50 may include a pressure applying unit for applying pressure to the ink container 31 through the pressure applying opening 24.

Moreover, in the above described embodiment, the second perforation lines 25 and 26 are formed approximately in parallel with the Z-X plane so as to go around the outer surface of the outer box 2. However, the positions where the second perforation lines 25 and 26 are formed and the shape formed by the second perforation lines 25 and 26 are not limited to the examples as long as the outer box 2 can be broken and divided. For example, the second perforation lines 25 and 26 can be formed approximately in parallel with the Y-Z plane going across the bottom surface 20*a*, the upper surface 20*b* and the side surfaces 20*e* and 20*f* or can be formed only in a part of the outer box 2 and not formed around the entire circumference of the outer box 2. Further, the second perforation lines 25 and 26 can form curved lines and not straight lines as shown in the drawings.

Further, the outer box 2 may not have the second perforation lines 25 and 26 formed thereon.

Further, in the above described embodiment, ink is output and supplied in to the inkjet recording apparatus 100 in the state where the lead-out section 321 of an ink cartridge 1 facing downward. However, this is not limitative in any way. That is, since a user can apply pressure to the ink container 31 through the pressure applying opening 24 according to the ink cartridge 1 of the present invention, the lead-out section 321 may face in any direction when ink is to be output.

Furthermore, in the above described embodiment, the protruding sections 323 of the ink pack 3 are positioned differently according to the color of the ink contained therein. However, this is not limitative in any way. The protruding sections 323 of the ink pack 3 can be positioned differently according to a property other than the color of the ink contained therein.

Similarly, in the above described embodiment, the concave sections 53 of the ink supply unit 50 are formed in different directions according to the different colors of ink. However, this is not limitative in any way. The concave sections 53 of the ink supply unit 50 can be formed so as to face in different directions according to a property other than the colors of the ink.

Moreover, in the above described embodiment, the ink supplied from the ink pack 3 is transferred in to the intermediate tank 51 at once. However, the ink can be transferred in to a plurality of ink tanks.

INDUSTRIAL APPLICABILITY

The present invention can be applied to an ink cartridge and inkjet recording apparatus.

DESCRIPTION OF REFERENCE NUMERALS

1 ink cartridge
2 outer box
3 ink pack
21 ink lead-out opening
22 incision
23 first perforation line
24 pressure applying opening
25 second perforation line
31 ink container
32 ink lead-out section
51 intermediate tank (ink tank)
52 setting section
53 concave section
54 introducing pipe
100 inkjet recording apparatus
321 lead-out section
323 protruding section
521 placement surface

The invention claimed is:

1. An ink cartridge in which gel ink that is to be supplied to an ink tank of an inkjet recording apparatus is reserved, comprising:

an ink pack including an ink container formed of a soft film material in which the ink is contained, and an ink lead-out section which guides the ink inside the ink container to an outside of the ink container; and an outer box which houses the ink pack and which has an ink lead-out opening through which the ink lead-out section is exposed outside, wherein the outer box has a pressure applying opening formed therein through which the ink container is exposed and a pressure is capable to be applied to the ink container or has a first perforation line along which the outer box is to be broken to form the pressure applying opening formed thereon, and the outer box has an upper surface and a side surface, and the pressure applying opening extends over the upper surface and the side surface.

2. The ink cartridge of claim 1, wherein the outer box has a second perforation line along which the outer box is to be broken to connect the ink lead-out opening and the pressure applying opening formed thereon.

3. The ink cartridge of claim 1, wherein the ink lead-out section comprises:

a lead-out section which is made to communicate with an inside of the ink container and which guides the ink to the outside of the ink container, and a protruding section which is formed around the lead-out section and which protrudes in an axis direction of the lead-out section, wherein the protruding section is positioned according to a type of the ink contained in the ink container.

4. The ink cartridge of claim 1, wherein a plurality of incisions are made in the outer box around the ink lead-out opening, and the ink lead-out section is fixed to the outer box by engaging with the plurality of incisions.

5. An inkjet recording apparatus which includes an ink tank in which ink is supplied from the ink cartridge of claim 1, comprising:

a setting section where the ink cartridge is set;

a concave section which is formed in a placement surface of the setting section where the ink cartridge is placed and which matches a shape of the ink lead-out section of the ink cartridge, and an introducing pipe which is set in the concave section, which opens the ink lead-out section by breaking a seal and which is made to communicate with the ink tank.

* * * * *